United States Patent [19]

Francis et al.

[11] 4,050,053

[45] Sept. 20, 1977

[54] RESISTOR END TERMINATIONS

[75] Inventors: Gaylord L. Francis, Califon; Amedeo J. Morelli, Randolph, both of N.J.

[73] Assignee: North American Philips Corporation, New York, N.Y.

[21] Appl. No.: 679,167

[22] Filed: Apr. 22, 1976

[51] Int. Cl.[2] ..... H01C 1/148; H01C 1/142

[52] U.S. Cl. ..... 338/332; 338/272; 338/327

[58] Field of Search ..... 338/272, 274, 322, 323, 338/327, 328, 332, 313

[56] References Cited

U.S. PATENT DOCUMENTS

| | | | |
|---|---|---|---|
| 1,671,469 | 5/1928 | Egly | 338/327 |
| 3,107,179 | 10/1963 | Kohring | 29/621 X |
| 3,249,904 | 5/1966 | Karalis et al. | 338/274 X |
| 3,358,362 | 12/1967 | McElroy | 29/620 X |

FOREIGN PATENT DOCUMENTS

| | | | |
|---|---|---|---|
| 239,216 | 12/1926 | United Kingdom | 338/327 |

OTHER PUBLICATIONS

R. Glang, *Metal Contacts for Cermet Film Resistors*, "IBM Technical Disclosure Bulletin", vol. 9, No. 6, Nov. 1966, p. 581.

*Primary Examiner*—C. L. Albritton

*Attorney, Agent, or Firm*—Frank R. Trifari; Daniel R. McGlynn

[57] ABSTRACT

A resistor end termination consisting of aluminum or aluminum alloy, deposited on a resistor core, for providing secure and reliable electrical and mechanical connection between the resistor element and the cap and lead assembly of an electrical resistor.

1 Claim, 2 Drawing Figures

RESISTOR END TERMINATIONS

BACKGROUND OF THE INVENTION

The invention relates to electronic components, and more particularly resistance devices formed on a resistor core.

The resistors in question consists of a resistive film applied to an insulating core material, such as a ceramic. Leads are attached to opposed ends of the resistor core, and the particular value of the resistor is determined by the resistivity of the coated film over the resistor core between electrical contact points of the opposed ends. In order to provide a secure mechanical connection between the leads and the resistor core, caps are attached to the leads and surround the opposed ends of the resistor core. Such caps provide both electrical and mechanical connection between the resistor film and the leads.

For high value resistors, that is, for resistance in excess of 1000 ohms, it is generally not critical that the cap be secured to the resistor core at a critically predetermined point. The reason is that a relative displacement between the cap and resistor core will not substantially change the value of the resistor. This is not the case, however, with smaller valued resistors, in which the slightest shift or change of the electrical connection point between the cap and the resistive core will mean a large change in the total value in the resistor.

The prior art resistors have used gold as an end termination coating for securing the cap to the resistor element. In addition to being expensive, gold does not provide a suitably reliable electrical and mechanical connection.

SUMMARY OF THE INVENTION

It is the object of the invention to provide a reliable electrical and mechanical connection between the cap assembly and the core of an electrical component.

It is another object of the invention to provide an inexpensive composition for making electrical contact between the cap assembly and the film coated core of a resistor.

It is yet another object of the invention to provide a low resistance interface material for minimizing contact shift between the cap and core of an electrical component.

It is still another object of the invention to provide aluminum or aluminum alloys as an end termination of a core element of an electrical component.

The invention provides an insulating resistor core, coated with a resistor film, and including a aluminum end band deposited over the resistor film at the opposed ends of the resistor core, Another broad aspect of the invention concerns a film type resistor, comprising an elongated cylindrical substrate; a resistor film provided adherently on the cylinderical surface of said substrate; a first termination film, composed of at least aluminum, being adherently provided in at least partially laminated relationship relative to portions of said resistor film on the opposed end portions of said cylinderical substrate; and means for connecting said termination film to a terminal lead, comprising a cap surrounding said end portions of said substrate and in electrical contact with said termination film.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

DESCRIPTION OF THE PREFERRED EMBODIMENTS

Figure 1:
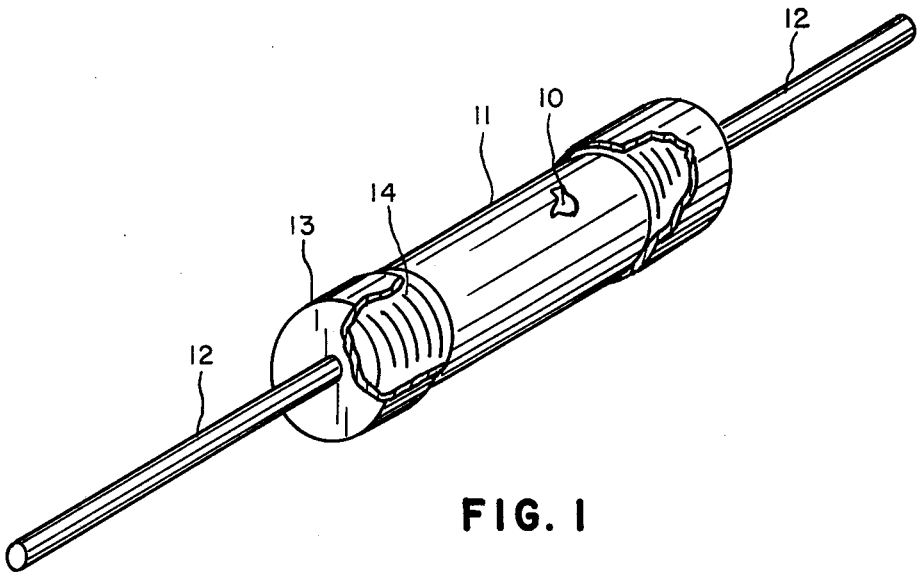
FIG. 1 is a cutaway perspective view of a resistor having an aluminum end termination as taught by the present invention.

FIG. 1 shows a cut away perspective view of the resistor having an aluminum end band termination according to the present invention. The resistor is formed of an insulating core material 10 upon which a resistive film 11 is deposited. The value of the resistor depends on the resistivity of the film 11, and how it is cut or spiraled between the two opposed ends of the resistor. Electrical contact to the opposed ends of the resistor are made by leads 12. The leads 12 are typically composed of copper. Attached to the leads are caps 13 which surround the opposed edges of the resistor making secure mechanical and electrical contact with the opposed ends. Deposited on the ends of the resistor over the resistive film 11 are end bands 14 between 1000 and 50,000 Angstrohms thick composed of aluminum alloy.

It has been found that to use aluminum or an aluminum alloy for the end banding material is superior to other elements, such as gold, gold plated copper, silver, or nickel. The disadvantages of these previously known compositions are well known: gold is expensive; nickel oxidizes after relatively long test periods; and copper-clad bands have an increase in resistance over time (the increase in resistance when utilizing copper is believed to be due to the solid state alloy of the copper with the metal film used for the resistor). Aluminum is therefore believed to be superior than copper since it is less active.

The use of aluminum was not abvious since it was originally believed that aluminum would oxidize and anodize, therefore decreasing the reliability of the mechanical and electrical characteristics of the component. In fact, it was found that oxidation substantially does not occur, and therefore these effects do not change the mechanical and electrical properties of the resistor. One advantage of aluminum is that it is soft material, has better mechanical properties, and is easier to work with in a production environment. Furthermore, it has a relatively low resistance so that that the effect of any contact shift is minimized.

The purpose of the aluminum or aluminum alloy end band is to provide a uniform, low resistant contact between the resistive film 11 and the cap 13. By using aluminum rather than no end band, there would be little or no resistance change in the value of the resistor as measured between the two leads 12 due to a shift of the cap and lead assembly 12, 13 during the manufacturing and assembly process. The superiority of aluminum compared with the more commonly used gold is demonstrated from the following table of test data on resistors with a resistance of less than 200 ohms, and greater than 200 ohms.

TEST DATA

| Resistors Less Than 200Ω | End Band Material | |
|---|---|---|
| | Aluminum | Gold |
| Process %ΔR | 0.02 | 0.169 |
| Load Life %ΔR (Rated Voltage At 125° C For 2000hr) | 0.023 | 0.196 |
| High Temperature Exposure %ΔR (175° C For 2000hr) | 0.085 | 1.58 |
| Resistors Over 200Ω: | | |
| Process %ΔR | 0.0083 | 0.025 |
| Load Life %ΔR (Rate Voltage At 125° C For 2000 hr) | 0.073 | 0.074 |
| High Temperature Exposure %ΔR (175° C For 2000 hr) | 0.06 | 1.038 |

(ΔR is the change in resistance of the resistor being tested)

The present invention therefore achieves a significant improvement over the previously used gold by providing substantially lower change in the value of the resistor during the manufacturing process, during load tests over 2000 hours, and during high temperature exposure for 2000 hours.

Figure 2:
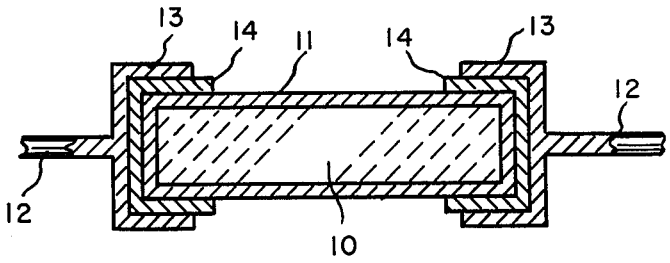
FIG. 2 is a cross-sectional view of the resistor of FIG. 1 through the resistor of FIG. 1 through the axis.

FIG. 2 is a cross-sectional view of the resistor according to the present invention through the axis of the cylinder. The cross-sectional view is more particularly used to illustrate the placement of the end band termination film. The aluminum is adherently provided in at least partially laminated relationship relative to portions of the resistive film 11 on the opposed end portions of the cylinderical substrate. FIG. 2 shows the embodiment in which the end band termination film 14 extends cylinderically around portions of the end regions of the cylinderical substrate 10 over the resistor film 11, as well as over the end faces of the substrate 10. In another embodiment, the aluminum film 14 is placed under the resistive film 11 at the opposed end portion of the cylinder coil substrate.

While the invention has been illustrated and described as embodied in Resistor End Terminations, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, form the standpoint of prior art, fairly constitutes essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A film-type resistor, comprising an elongated cylindrical substrate;

a resistive film provided adherently on the cylindrical surface of said substrate;

a termination film, composed solely of aluminum, being adherently provided in at least partially laminated relationship relative to portions of said resistive film on the opposed end portions of said cylindrical substrate; and means for connecting said termination film to a lead, comprising a cap surrounding said end portions of said substrate and in electrical contact with said termination film.

* * * * *